United States Patent [19]

Swanson

[11] Patent Number: 4,742,619

[45] Date of Patent: May 10, 1988

[54] MARKING TOOL WITH WEAR RIMS

[76] Inventor: Ronald C. Swanson, 9240 S. Austin, Oak Lawn, Ill. 60453

[21] Appl. No.: 912,045

[22] Filed: Sep. 25, 1986

[51] Int. Cl.[4] ..... B43L 13/00

[52] U.S. Cl. ..... 33/474; 33/492; 33/494

[58] Field of Search ..... 33/474, 477, 476, 475, 33/480, 493, 494, 489, 492

[56] References Cited

U.S. PATENT DOCUMENTS

| | | | |
|---|---|---|---|
| 265,383 | 10/1882 | Callihan | 33/474 |
| 437,870 | 10/1890 | Smith | 33/474 |
| 1,249,132 | 12/1917 | Leavens | 33/493 |
| 2,076,300 | 4/1937 | Croix | 33/492 |
| 3,178,826 | 4/1965 | Aisen | 33/492 |

FOREIGN PATENT DOCUMENTS

| | | | |
|---|---|---|---|
| 908490 | 9/1945 | France | 33/489 |

*Primary Examiner*—William D. Martin, Jr.
*Attorney, Agent, or Firm*—John Vander Weit, Jr.

[57] ABSTRACT

A tool useful for marking and constructed of a flexible material which includes a flat member having a structural layer of a predetermined shape with first and second parallel surfaces, the structural layer having marking edges perpendicular to the first and second parallel surfaces for measuring, aligning and marking, a first wear rim along the marking edges extending a uniform distance away from the first parallel surface of the structural layer, a second wear rim along the marking edges extending a uniform distance away from the second parallel surface of the structural layer, a plurality of first marking indicia on and extending away from the first parallel surface along the first wear rim, a plurality of second marking indicia on and extending away from the second parallel surface along the second wear rim, wherein the first wear rim extends away from the first parallel surface a greater distance than the first marking indicia extend away from the first parallel surface, and wherein the second wear rim extends away from the second parallel surface a greater distance than the second marking indicia extend away from the second parallel surface.

20 Claims, 1 Drawing Sheet

MARKING TOOL WITH WEAR RIMS

BACKGROUND OF THE INVENTION:

This invention relates generally to measuring tools and more particularly concerns a measuring tool constructed of a flexible material. In the past, measuring tools have usually been constructed of non-flexible materials so as to avoid warping, and variations in measurements due to flexing. Non-flexible materials, such as metals and the like, provide rigidity and additionally wear well when subjected to use on a working surface and the nicks and bumping of other tools in a workman's toolbox. However, due to the high costs of metals, it is desirable to provide a measuring tool made of a lower cost flexible material.

In constructing a measuring tool of flexible material, a common way is by injection molding plastics. However, with injection molding the tool cannot be made excessively thick so as to withstand the wear and hazards mentioned above, since if it is made too thick, the processing time in cooling the plastic and the cost of material increase the cost of the tool to that of metal measuring tools. Moreover, when the tool is made of thick layers of plastics, shrinkage and warpage in cooling become a serious problem in providing for precise measuring indications. Thus, it is necessary to maintain the measuring tool as thin as possible in order to avoid shrinkage, warpage, increased costs of materials and increased processing time. However, as a tool is made thinner, the flexible nature of the plastic increases the problems in using the tool to mark or align.

Likewise the marking indicia for the measurement scales must be raised from the surface of the measuring tool in order to avoid excessive thickness. If they are imbedded or depressed into the structure of the tool, then the structure would have to be thicker. Unfortunately, since the raised marking indicia must be thin so they can provide a precise indication of the measurement alignment, they are even more prone to being worn off, abraded, chipped, broken and the like during use and storage in a toolbox.

Still another problem in constructing a measuring tool of a flexible material is that such tools are commonly moved slidably back and forth across wood or other work surfaces in order to mark the work surface, used as a guide for saw blades, and used in other abrasive environments. If raised marking indicia are allowed to slide across the surface being measured they will rapidly be abraded and worn off when the flexible material is used. Moreover, rather than simply putting the raised marking indicia on the upper surface of the tool and leaving the lower surface flat for sliding on the work surface it is more desirable to have as many different scales or different measuring indications on the tool. Thus, it is usually necessary to have marking indicia on both the upper and lower surface of the tool.

Accordingly, it is the primary aim of the invention to provide a measuring tool constructed of a flexible material with raised marking indicia which are not subject to excessive wear, premature breaking or abrasion of the measuring indicia, while allowing the thickness of the tool to be kept as thin as possible.

A further object is to provide a measuring tool constructed of a flexible material with raised marking indicia wherein the marking indicia do not slide back and forth on the work surfaces which are measured.

Still another object of the invention is to provide a measuring tool with raised marking indicia on both upper and lower surfaces of the tool.

Still another object of the invention is to provide a measuring tool with marking indicia constructed of a flexible material which will minimize the problem of parallax.

SUMMARY OF THE INVENTION

In accordance with the invention, a tool useful for marking and constructed of a flexible material is provided which includes a flat member having a structural layer of a predetermined shape with first and second parallel surfaces, the structural layer having marking edges perpendicular to the first and second parallel surfaces for measuring, aligning and marking, a first wear rim along the marking edges extending a uniform distance away from the first parallel surface of the structural layer, a second wear rim along the marking edges extending a uniform distance away from the second parallel surface of the structural layer, a plurality of first marking indicia on and extending away from the first parallel surface along the first wear rim, a plurality of second marking indicia on and extending away from the second parallel surface along the second wear rim, wherein the first wear rim extends away from the first parallel surface a greater distance than the first marking indicia extend away from the first parallel surface, and wherein the second wear rim extends away from the second parallel surface a greater distance than the second marking indicia extend away from the second parallel surface.

BRIEF DESCRIPTION OF THE DRAWINGS

Other objects and advantages of the invention will become apparent upon reading of the following detailed description and upon reference to the drawings, in which.

Figures 1, 2, 3, 4, 5:
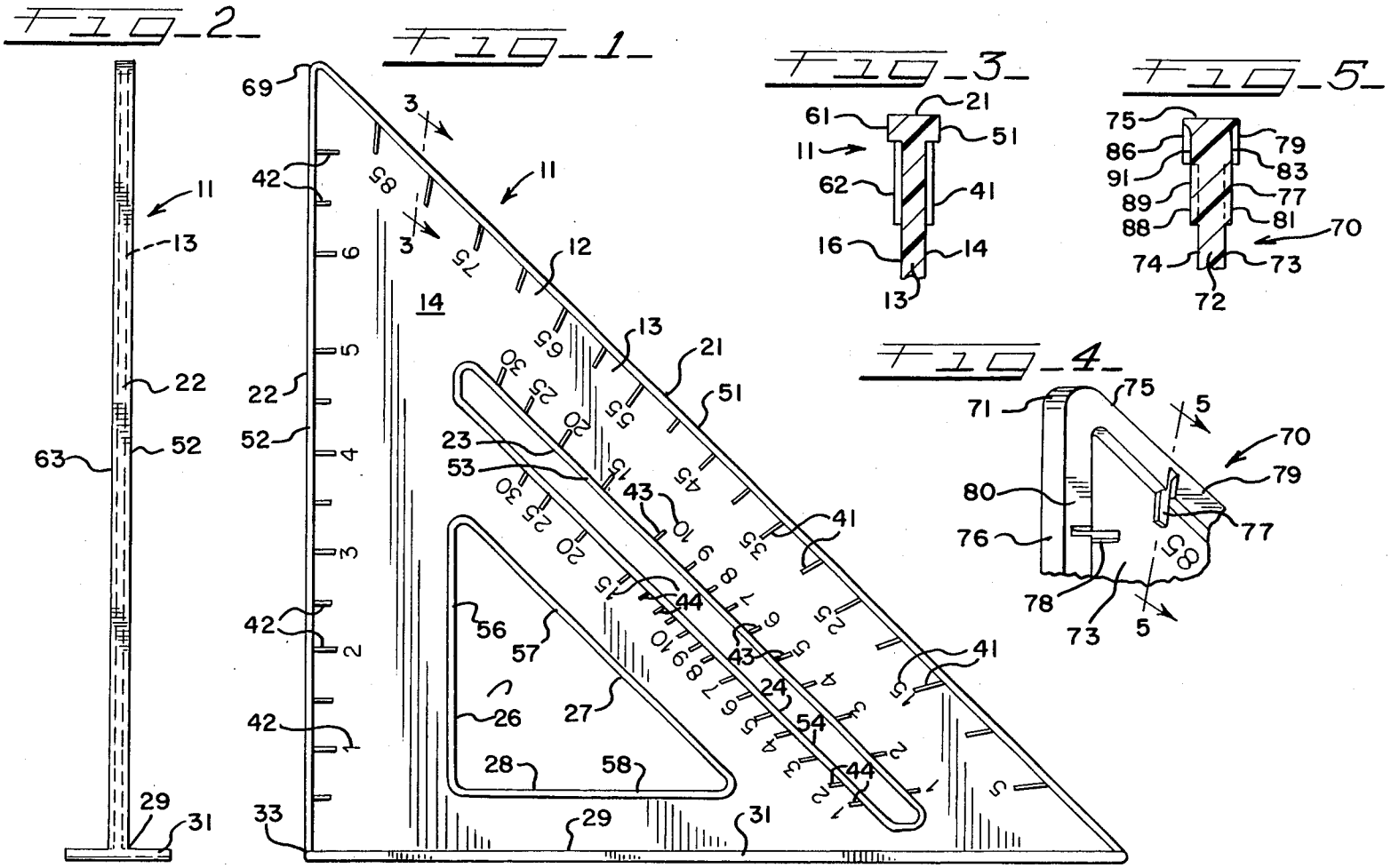
FIG. 1 is a plan view of a measuring tool constructed in accordance with the instant invention.
FIG. 2 is a side view of the tool of FIG. 1.
FIG. 3 is a partial side sectional view of the tool of FIG. 1 taken along sight line 3—3.
FIG. 4 is a partial perspective view of another tool constructed in accordance with the instant invention; and, FIG. 5 is a partial side sectional view of the tool of FIG. 4 taken along sight line 5—5.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Turning first to FIG. 1, there is shown a measuring tool 11 constructed in accordance with the instant invention. Measuring tool 11 includes a flat member 12 having a structural layer 13 with a first parallel surface 14. The opposite side of structural layer 13 has a second surface 16 similar to first parallel surface 14. First parallel surface 14 is parallel to second parallel surface 16. Tool 11 has exterior marking edges 21 and 22. Tool 11 also has interior marking edges 23 and 24 and internal edges 26, 27 and 28. Tool 11 also has an abutment edge 29. Abutment edge 29 is attached to an abutment tee 31.

Exterior marking edge 21 has marking indicia 41 alongside it. Exterior marking edge 22 has marking indicia 42 alongside it. Interior marking edge 23 has marking indicia 43 alongside it. Interior marking edge 24 has marking indicia 44 alongside it. Marking indicia 41 define, for example, a scale of the degrees from a pivot point 33 which can be marked by a user aligning a marker alongside marking edge 21. Marking indicia 42 define a scale of inches and can be marked accordingly along marking edge 22. Marking indicia 23 indicate the common rafter measurement which can be marked along marking edge 23 and marking indicia 44 indicate the measurements for a valley rafter or a hip rafter which can be marked along marking edge 24. The use of these scales is well known in the art and has been defined in a booklet entitled the "*The Speed Square Book*", published by Swanson Tool Company, Inc., P.O. Box 434, Oak Lawn, Ill. 60453, and identified as item #00102 which is incorporated herein by reference. The use of these scales is not important to the description of the instant invention, other than to show how the tool is constantly being slid across the work surface when being used. However, the marking indicia can be of any desired type and can be used to make any desired measurements or alignments. Tool 11 is commonly referred to as a square and the scales are particularly useful in measuring, aligning and marking rafter lengths and cuts in construction of a roof. However, the instant invention would be applicable to any measuring tool of any desired shape and could be adapted to such a tool according to the teachings of the instant invention.

In use, for example, one aligns abutment edge 31 against the side of a board, slides pivot point 33 to the desired location, aligns marking indicia 41 along the edge of the board to the desired measurement, and marks a line along marking edge 21. Thus, during use of tool 11, the tool is slid in a direction parallel to abutment edge 29 along the length of a board and is additionally slid in a circular motion along pivot point 33 to find the desired angle. Thus, it can be seen that tool 11 is constantly being abraded against the wood in being used to align and mark the board for the cuts desired.

In order to avoid rapid abrasion of the marking indicia, wear rim 51 is formed along marking edge 21. Wear rim 52 is similarily formed along marking edge 22. Wear rim 53 is formed along marking edge 23 and wear rim 54 is formed along marking edge 24. Similarily wear rim 56 is formed along internal edge 26, wear rim 57 is formed along internal edge 27 and wear rim 58 is formed along internal edge 28. Wear rims 51, 52, 53, 54, 56, 57 and 58 are all formed at a uniform height away from and above first surface 14. Thus, all of the wear rims are capable of contact with a flat board and will allow tool 11 to slide along the wear rims instead of along the marking indicia.

Similar to first parallel surface 14 shown in FIG. 1, as best shown in FIG. 3, the second parallel surface 16 of tool 11 is similar to the side shown in FIG. 1. In FIG. 3, a wear rim 61 is shown with marking indicia 62. As best seen in FIG. 3, wear rims 51 and 61 extend away from structural layer 13 a greater distance than the respective marking indicia 41 and 62. Similarly, as best seen in FIG. 2, wear rim 63 extends away from parallel surface 16 to protect marking indicia along marking edge 22. This allows the wear rims to protect the marking indicia from the abrasion commonly found in regular use of the tool and additionally protects the marking indicia from the hazards of being joustled around and bumping other tools in a toolbox.

The "flexible material" used for construction off the tool may be any of the common plastics suitable for use in injection molding. Such plastics are well known in the art. Some examples of flexible materials are polyurethanes, polyvinyls, polyvinyl chlorides, polypropylenes and the like. However, any other suitable plastic may be used. The "flexible material" may be quite strong, but since it is desired to have the marking indicia as narrow as possible to allow accurate alignment, the indicia will still be subjected to rapid wear or breakage from abrasion and impact. Structural layer 13 may have a thickness within the range of from 0.075 inch to 0.150 inch. It is desired to have marking indicia be raised a distance of from 0.020 inch to 0.030 inch above the first and second parallel surfaces 14 and 16 of structural layer 13 in order to provide adequate identification and visability of the marking. This allows a viewer to easily see the marking indicia by the variations in light on the sides of the marking indicia. The contrast between the lighted part and the shaded part makes the marking indicia readily viewable. It is further desired to have the wear rims extend a distance of approximately 0.005 inch to 0.010 inch above the marking indicia. It is found when the marking indicia are in the range of 0.020 inch to 0.030 inch and the wear rims are in the the range of 0.005 inch to 0.010 inch higher than the marking indicia, that adequate protection for the marking indicia is accomplished. Additionally, wear rims around the internal edges 26, 27 and 28 provide not only additional protection against abrasion, but also structural rigidity for the flexible tool. Thus, all of the wear edges together provide for additional rigidity in the flexible tool without having the additional thickness in structural layer 13.

Wear rims 51, 52, 53 and 54 extend approximately 0.050 inch to 0.075 of an inch from the respective marking edges 21, 22, 23 and 24. If the wear rims are less than 0.050 inch wide, they are themselves too weak and easily abraded. However, if the wear rims are more than 0.075 inch from the marking edge, they provide a parallax problem in aligning and using the tool. Thus, an extremely wide wear rim, while allowing for better protection of marking indicia, causes the tool to be hard to use and inaccurate. Internal wear rims 56, 57 and 58 can be made wider than wear rims 51, 52, 53 and 54 since they are not used to measure or align and the parallax problem does not occur. However, they still cannot be so wide as to cause significantly longer cooling time in manufacture by injection molding. Thus, a wear rim, internally or externally, which does not have marking indicia alongside it, can be from 0.100 inch to 0.150 inch without causing problems in cooling during injection molding or parallax.

In order to alleviate the parallax problem with a wider wear rim, another tool 70 constructed in accordance with the instant invention is shown in FIGS. 4 and 5. Tool 70 is similar to tool 11 with a portion similar to the corner 69 of FIG. 1 being shown as corner 71 in FIG. 4. Tool 70 has a structural layer 72 with a first parallel surface 73 and a second parallel surface 74. Tool 70 also has a marking edge 75 and a marking edge 76. Alongside marking edge 75 are marking indicia 77 and a wear rim 79. Alongside marking edge 76 are marking indicia 78 and a wear rim 80.

Marking indicia 77 are raised from first parallel surface 73. However, marking indicia 77 continue into wear rim 79 by being depressed into the surface of wear rim 79. Thus, marking indicia 77 are raised at the portion 81 above first parallel surface 73 and are depressed at the portion 83 inside wear rim 79. The depressed portion 83 of marking indicia 77 extend almost to marking edge 75. The depressed portion of the marking indicia can extend as close as 0.001 inch to the marking edge. This construction allows the marking edge to be unnotched, which avoids causing a marking instrument such as a pencil to be caught on the depression of portion 83 of marking indicia 77 if it were extended all the way through wear rim 79. The depressed portion 83 of marking indicia 77 allows the marking indicia to be visably seen almost at marking edge 75. This construction allows all of the advantages and satisfies all of the requirements in constructing tool 70 of a flexible material as well as eliminating to a maximum extent the problem of parallax. Marking indicia 88 are raised from second parallel surface 74. However, marking indicia 88 continue into wear rim 86 by being depressed into the surface of wear rim 86. Thus, marking indicia 88 are raised at the portion 89 above second parallel surface 74 and are depressed at the portion 91 inside wear rim 86. The depressed portion 91 of marking indicia 88 extend almost to marking edge 75. This also allows the full thickness of the combined wear rims 79 and 86 to provide structural support for tool 70. The depressed portion 91 of marking indicia 88 allows the marking indicia to be visably seen almost at marking edge 75. Thus, the wear rim can be made somewhat wider as desired for a particular type of tool and marking indicia can be provided which will allow for easy and accurate measuring, marking and alignment of the tool.

Thus it is apparent that there has been provided, in accordance with the invention, a tool that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A tool useful for marking and constructed of a flexible material, including:

a flat member having a structural layer of a predetermined shape with first and second parallel surfaces;

said structural layer having external marking edges perpendicular to said first and second parallel surfaces for measuring, aligning and marking;

a first wear rim along said external marking edges extending a uniform distance away from said first parallel surface of said structural layer;

a second wear rim along said external marking edges extending a uniform distance away from said secnd parallel surface of said structural layer;

a plurality of first marking indicia on and extending away from said first parallel surface along said first wear rim;

a plurality of second marking indicia on and extending away from said second parallel surface along said second wear rim;

wherein said first wear rim extends away from said first parallel surface a greater distance than said first marking indicia extend away from said first parallel surface; and, wherein said second wear rim extends away from said second parallel surface a greater distance than said second marking indicia extend away from said second parallel surface.

2. A tool as in claim 1 wherein said first marking indicia extend from 0.020 inches to 0.030 inches away from said first parallel surface.

3. A tool as in claim 1 wherein said second marking indicia extend from 0.020 inches to 0.030 inches away from said first parallel surface.

4. A tool as in claim 1 wherein said first wear rim extends from 0.005 inches to 0.010 inches farther from said first parallel surface than said first marking indicia extend from said first parallel surface.

5. A tool as in claim 1 wherein said second wear rim extends from 0.005 inches to 0.010 inches farther from said second parallel surface than said second marking indicia extend from said second parallel surface.

6. A tool as in claim 2 wherein said first wear rim extends from 0.005 inches to 0.010 inches farther from said first parallel surface than said first marking indicia extend from said first parallel surface.

7. A tool as in claim 3 wherein said second wear rim extends from 0.005 inches to 0.010 inches farther from said second parallel surface than said second marking indicia extend from said second parallel surface.

8. A tool as in claim 1 wherein said structural layer has exterior marking edges and interior marking edges.

9. A tool as in claim 1 wherein said structural layer has internal edges not used for marking which have internal wear rims extending along said internal edges and extending a uniform distance away from said first and second parallel surfaces.

10. A tool as in claim 9 wherein said first wear rims, said second wear rims and said internal wear rims all extend a uniform distance away from said first and second parallel surfaces.

11. A tool as in claim 1 wherein said first wear rims extend from between 0.050 inches to 0.075 inches from said marking edge.

12. A tool useful for marking and constructed of a flexible material, including:

a flat member having a structural layer of a predetermined shape with first and second parallel surfaces;

said structural layer having marking edges perpendicular to said first and second parallel surfaces for measuring, aligning and marking;

a first wear rim along said marking edges extending a uniform distance away from said first parallel surface of said structural layer;

a second wear rim along said marking edges extending a uniform distance away from said second parallel surface of said structural layer;

a plurality of first marking indicia on and extending away from said first parallel surface along said first wear rim;

a plurality of second marking indicia on and extending away from said second parallel surface along said second wear rim;

wherein said first wear rim extends away from said first parallel surface a greater distance than said first marking indicia extend away from said first parallel surface;

wherein said second wear rim extends away from said second parallel surface a greater distance than said second marking indicia extend away from said second parallel surface;

wherein some of said first marking indicia continue into said first wear rim by being depressed into said first wear rim.

13. A tool as in claim 12 wherein some of said second marking indicia continue into said second wear rim by being depressed into said second wear rim.

14. A tool as in claim 12 wherein said first marking indicia extend from 0.020 inches to 0.030 inches away from said first parallel surface.

15. A tool as in claim 12 wherein said first wear rim extends from 0.005 inches to 0.010 inches farther from said first parallel surface than said first marking indicia extend from said first parallel surface.

16. A tool as in claim 12 wherein some of said first marking indicia are depressed from 0.005 inches to 0.010 inches into said first wear rim.

17. A tool as in claim 12 wherein some of said first marking indicia extend into said first wear rim to within 0.001 inch from said marking edge.

18. A tool as in claim 12 wherein said wear rims extend from between 0.050 inches to 0.150 inches from said marking edge.

19. A tool as in claim 15 wherein said wear rims extend from between 0.050 inches to 0.150 inches from said marking edge.

20. A tool as in claim 19 wherein said first marking indicia extend from 0.020 inches to 0.030 inches away from said first parallel surface; and wherein some of said first marking indicia are depressed from 0.005 inches to 0.010 inches into said first wear rim.

* * * * *